US011167576B2

(12) United States Patent
Furuyama

(10) Patent No.: US 11,167,576 B2
(45) Date of Patent: Nov. 9, 2021

(54) PRINTER

(71) Applicant: BROTHER KOGYO KABUSHIKI KAISHA, Nagoya (JP)

(72) Inventor: Toshiyuki Furuyama, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/714,679

(22) Filed: Dec. 13, 2019

(65) Prior Publication Data

US 2020/0198382 A1 Jun. 25, 2020

(30) Foreign Application Priority Data

Dec. 21, 2018 (JP) ..... JP2018-239651

(51) Int. Cl.
*B41J 29/02* (2006.01)

(52) U.S. Cl.
CPC ..... *B41J 29/02* (2013.01)

(58) Field of Classification Search
CPC ..... B41J 29/02; B41J 2/14209; B41J 2002/14225; B41J 2002/14306; B41J 2002/14419; B41J 11/00; B41J 11/70
See application file for complete search history.

(56) References Cited

U.S. PATENT DOCUMENTS 6,732,619 B2 * 5/2004 Carriere ..... B26D 1/085 101/93.07
2006/0078365 A1 * 4/2006 Choh ..... B41J 29/02 400/693
2009/0091597 A1 * 4/2009 Silverbrook ..... G07F 17/3232 347/29

FOREIGN PATENT DOCUMENTS

JP 60-96482 A 5/1985

* cited by examiner

*Primary Examiner* — Thinh H Nguyen
(74) *Attorney, Agent, or Firm* — Kenealy Vaidya LLP

(57) ABSTRACT

A printer configured to perform a printing operation on a printing medium, including: a cylindrically shaped housing including a bottom surface and a cylindrical surface on which an outlet is formed, the housing being configured to be placed on a horizontal table in any of a first posture in which the bottom surface is opposed to the table and a second posture in which a specific portion of the cylindrical surface is opposed to the table, the outlet being formed at a position of the cylindrical surface at which the printing medium stored in the housing is dischargeable from the outlet irrespective of whether the housing takes the first posture or the second posture on the table; and a second-posture keeping structure to keep the housing in the second posture in a state in which the cylindrical surface is opposed to the table.

21 Claims, 10 Drawing Sheets

PRINTER

CROSS REFERENCE TO RELATED APPLICATION

The present application claims priority from Japanese Patent Application No. 2018-239651, which was filed on Dec. 21, 2018, the disclosure of which is herein incorporated by reference in its entirety.

BACKGROUND

Technical Field

The following disclosure relates to a printer.

Description of Related Art

A printer having a substantially cylindrical housing is known. For instance, a known printer includes a printer body, two legs, a platen roll, and a print head. The printer body is a cylindrically shaped housing. The two legs are provided on the outer circumferential surface of the printer body. The printer body is disposed on a table in a horizontal posture with the two legs placed on the table. The platen roll and the print head are disposed in the printer body. In a printing operation performed by the printer, print paper that has passed between the platen roll and the print head is discharged from the printer body.

SUMMARY

The known printer described above may be disadvantageous in that the printing operation can be performed only in the posture in which the two legs are placed on the table.

Accordingly, one aspect of the present disclosure is directed to a printer that can take a plurality of placement postures on the table in which the printing operation is performable.

In one aspect of the present disclosure, a printer configured to perform a printing operation on a printing medium includes: a housing having a cylindrical shape and including a bottom surface and a cylindrical surface on which an outlet is formed, the housing being configured to be placed on a horizontal table in any of a first posture in which the bottom surface is opposed to the table and a second posture in which a specific portion of the cylindrical surface is opposed to the table, the outlet being formed at a position of the cylindrical surface at which the printing medium stored in the housing is dischargeable from the outlet irrespective of whether the housing takes the first posture or the second posture on the table; and a second-posture keeping structure to keep the housing in the second posture in a state in which the cylindrical surface is opposed to the table.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which.

DETAILED DESCRIPTION OF THE EMBODIMENT

There will be hereinafter explained a printer 1 according to one embodiment. The printer 1 can perform a printing operation on a printing medium 7 (FIG. 3) and cut the printing medium 7 on which the printing operation has been performed. The printing medium 7 is a tape formed of heat-sensitive paper. The printer 1 of the present embodiment is portable with one hand.

Figure 1:
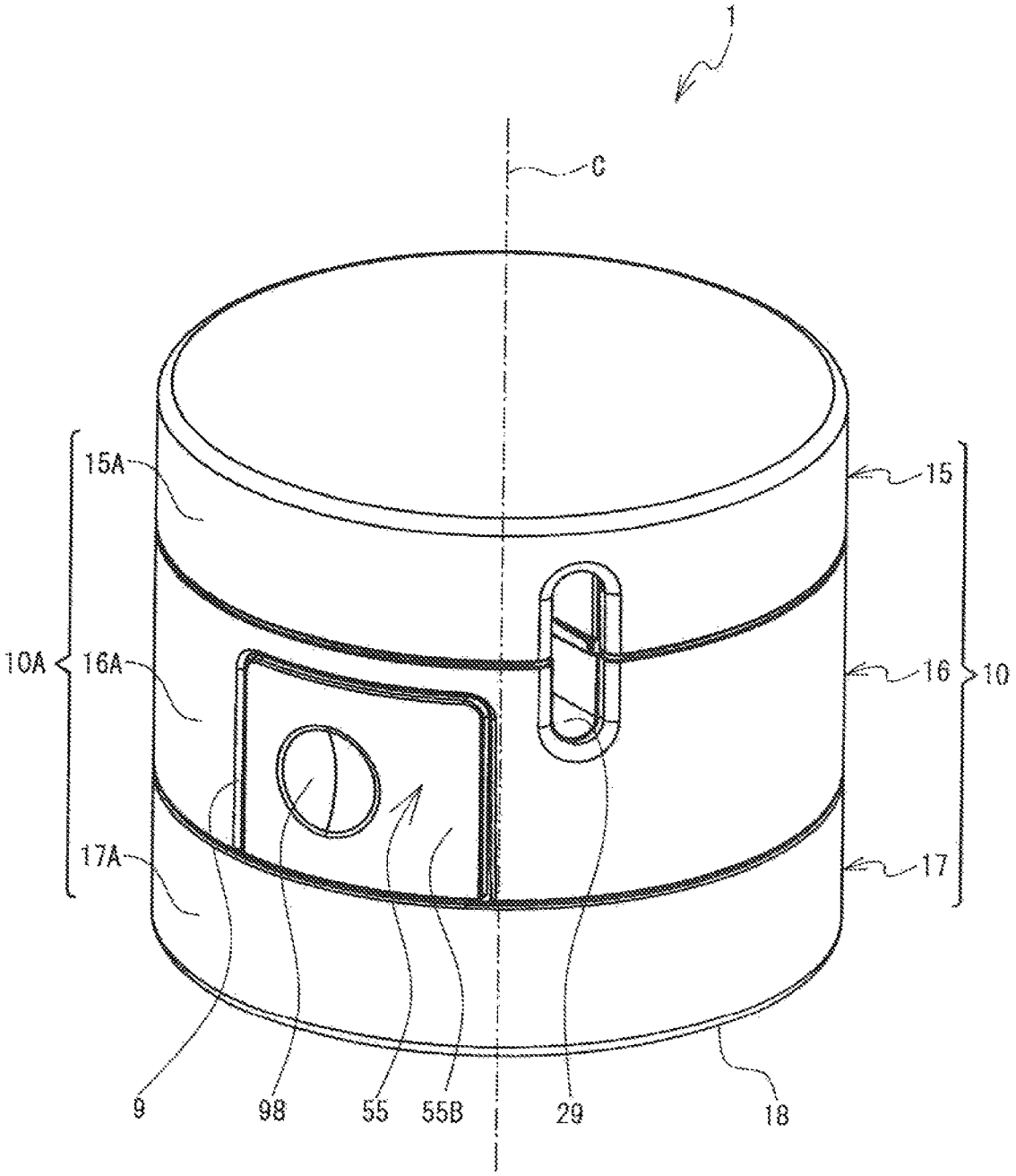
FIG. 1 is a perspective view of a printer that takes a first posture.
Figure 2:
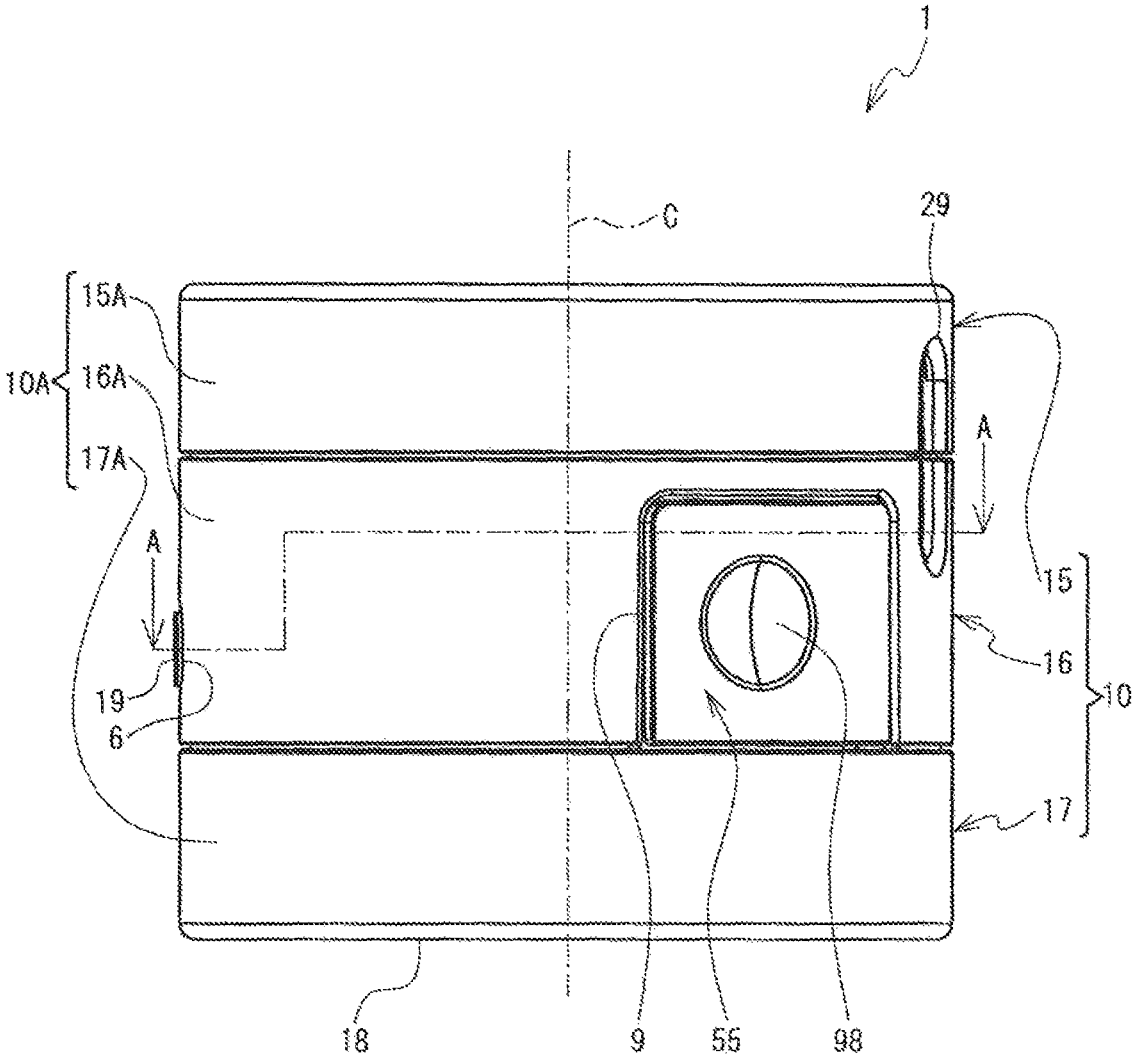
FIG. 2 is a side view of the printer.

As shown in FIGS. 1 and 2, the printer 1 includes a housing 10 having a cylindrical shape. The housing 10 may be substantially cylindrical. The housing 10 includes a lid portion 15, a cylindrical portion 16, and a lid portion 17. The lid portions 15, 17 close opposite openings of the cylindrical portion 16. In the following explanation, a direction of extension of an axis C of the housing 10 will be referred to as "axial direction". A radial direction with respect to the axis C will be referred to as "radial direction". One of mutually opposite axial directions that is directed from the lid portion 17 toward the lid portion 15 will be referred to as "first direction" while the other of the mutually opposite axial directions that is directed from the lid portion 15 toward the lid portion 17 will be referred to as "second direction". In this respect, one of opposite sides of the printer 1 that is closer to the lid portion 15 is defined as "first-direction side" and the other of the opposite sides that is closer to the lid portion 17 is referred to as "second-direction side".

The lid portion 15 has a downward extending portion (not shown) provided on its inner flat surface (not shown) having a circular shape. The downward extending portion extends from the lid portion 15 toward the second-direction side. An end surface of the lid portion 17 on the second-direction side is a circular flat surface 18 having a substantially circular shape. The circular flat surface 18 is one example of a bottom surface. Cylindrical surfaces of the lid portion 15, the cylindrical portion 16, and the lid portion 17 are respectively a cylindrical surface 15A, a cylindrical surface 16A, and a cylindrical surface 17A. These three cylindrical surfaces 15A-17A constitute a cylindrical surface 10A of the housing 10. The cylindrical surface 10A extends along the periphery of the circular flat surface 18.

An outlet 29 that extends in the axial direction is formed on the cylindrical surfaces 15A, 16A for permitting communication between an interior and an exterior of the housing 10. The outlet 29 may be formed on the cylindrical surfaces 15A, 16A so as to extend in a circumferential direction of the circular flat surface 18. The printing medium 7 stored in the housing 10 is dischargeable from the outlet 29. A lever opening 9 is formed on the cylindrical surface 16A. The lever opening 9 extends in the circumferential direction of the cylindrical portion 16 and is formed so as to penetrate the cylindrical portion 16 in the radial direction. The lever opening 9 exposes an operation lever 55 that will be explained.

A power-button opening 6 (FIG. 2) is formed at a portion of the cylindrical surface 16A that is substantially opposite to the outlet 29 relative to the axis C. The power-button opening 6 is a circular hole formed through the cylindrical portion 16 in the radial direction. The power-button opening 6 exposes a power button 19 that is a substantially cylindrical columnar member. A radially outer end face of the power button 19 partly constitutes the cylindrical surface 16A. The power button 19 is connected to a switch (not shown) provided on a board 90 (FIG. 4) disposed in the housing 10. When a user pushes the power button 19, the switch is set to ON, so that the printer 1 is turned on. There is provided, on the board 90, a CPU configured to control operations of the printer 1. The CPU is electrically connected to a communication device (not shown) disposed in the housing 10. The communication device is configured to receive print information from an external device disposed outside the printer 1. The print information indicates characters (such as letters, figures, and symbols) to be printed on the printing medium 7. The communication device outputs the received print information to the CPU.

Figure 3:
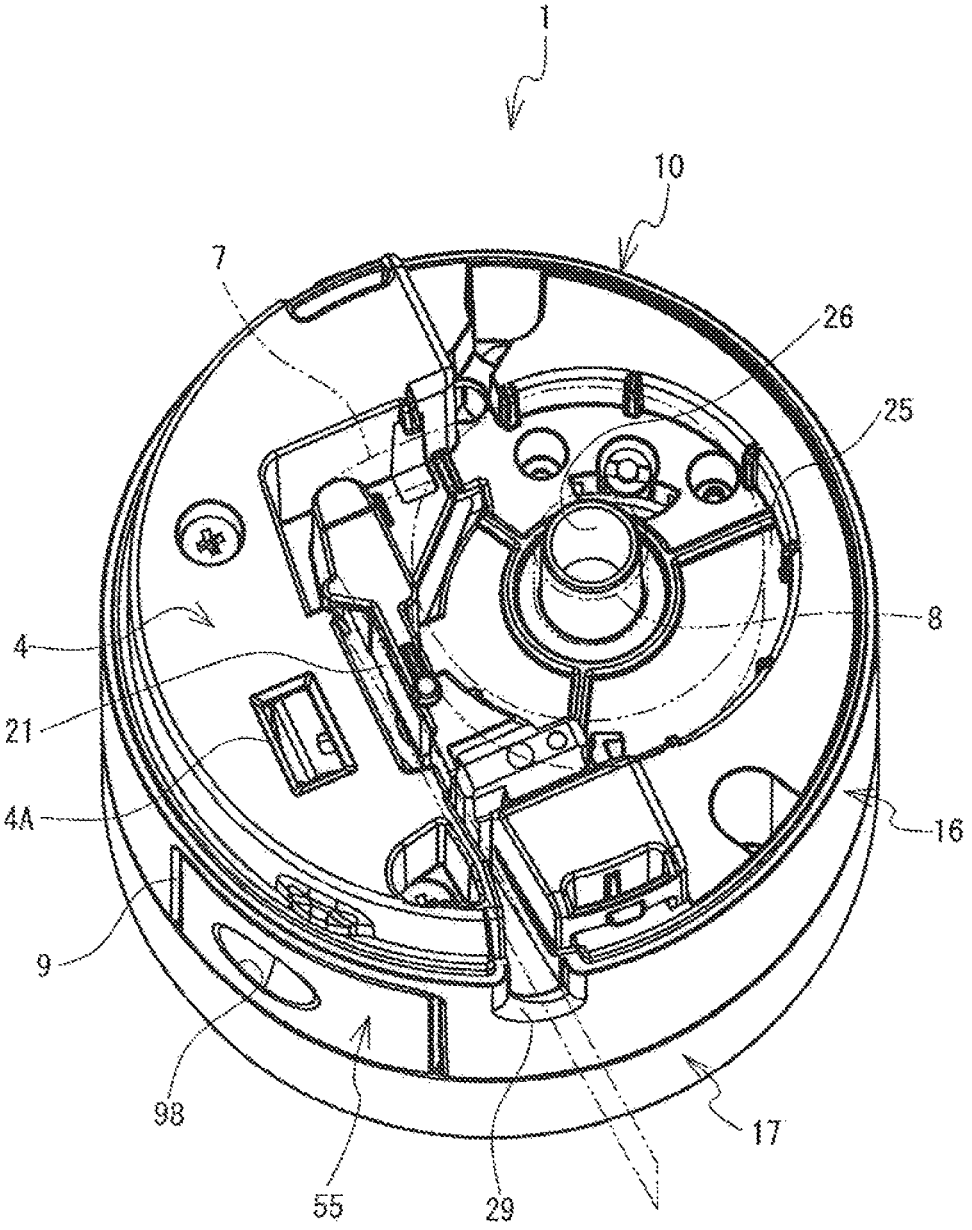
FIG. 3 is a perspective view of an inner structure of the printer.

As shown in FIG. 3, a mount portion 25 is provided in the housing 10. The mount portion 25 is a circular recess that is recessed toward the second-direction side. A mount shaft 26 that protrudes toward the first-direction side is disposed at the center of the mount portion 25. A cylindrical roll 8 around which the printing medium 7 is wound is rotatably mounted on the mount shaft 26. The printing medium 7 mounted on the mount portion 25 is drawn from the roll 8 and sent toward the outlet 29. Hereinafter, a path through which the printing medium 7 drawn from the roll 8 is sent to the outlet 29 will be referred to as "medium path".

A head 21 shaped like a plate is disposed so as to be opposed to the medium path. The head 21 is a thermal head including a plurality of heat generating elements arranged in the axial direction. The head 21 is electrically connected to the board 90 via a flexible flat cable 23 (FIG. 4).

An inner cover 4 is fixedly provided opposite to the head 21 relative to the medium path. The inner cover 4 is a plate having a certain thickness in the axial direction. The inner cover 4 is disposed on the first-direction side of the head 21 and has an insertion hole 4A that is open in the axial direction. The downward extending portion of the lid portion 15 (FIG. 1) is insertable into the insertion hole 4A. A conveyor mechanism 30 (FIG. 4) is provided on the second-direction side of the inner cover 4. The conveyor mechanism 30 cooperates with the head 21 to convey the printing medium 7.

Figure 4:
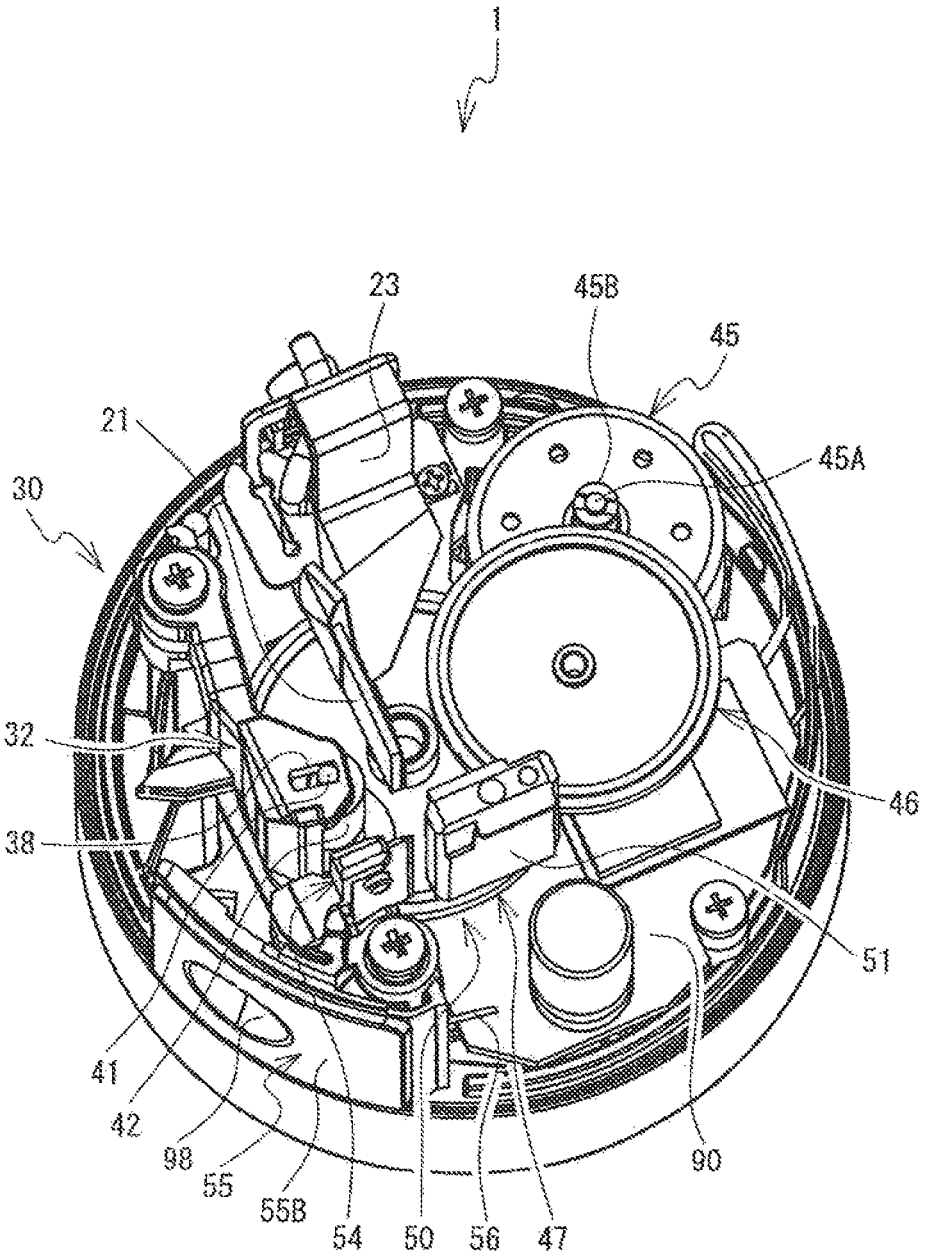
FIG. 4 is another perspective view of the inner structure of the printer.
Figure 5:
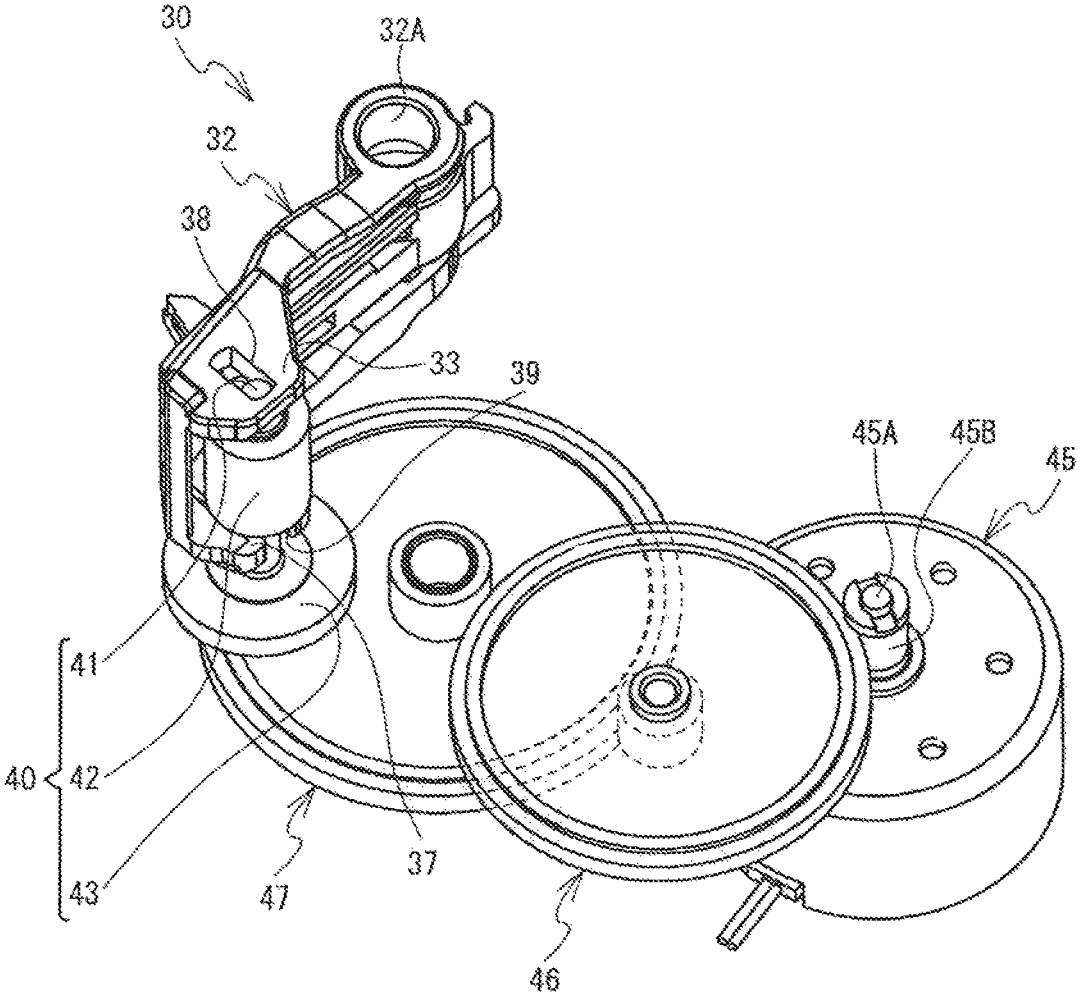
FIG. 5 is a perspective view of a conveyor mechanism and a motor.

As shown in FIGS. 4 and 5, the conveyor mechanism 30 includes a shaft portion 31 (FIG. 6), a platen holder 32, a platen roller 40, and a holder spring (not shown). The shaft portion 31 (FIG. 6) extends in the axial direction and is fixed in the cylindrical portion 16. The platen holder 32 extends orthogonally to the shaft portion 31. A circular hole 32A that is open in the axial direction is formed at one end of the platen holder 32, and the shaft portion 31 is held in the circular hole 32A. Thus, the platen holder 32 is pivotable about the shaft portion 31. There are formed, at the other end of the platen holder 32, a support portion 33 having an elongate hole 38 and a support portion 37 having a cutout 39. The elongate hole 38 and the cutout 39 are arranged so as to be align with each other in the axial direction. The elongate hole 38 is open in the axial direction. The cutout 39 is open in the axial direction. The cutout 39 is open also in a direction toward the head 21.

The platen roller 40 includes a roller shaft 41, a roller portion 42, and a roller gear 43. The roller shaft 41 extends in the axial direction so as to be rotatably held in the elongate hole 38 and the cutout 39. The roller shaft 41 is movable in the longitudinal direction of the elongate hole 38 and the cutout 39. The roller portion 42 is shaped like a cylinder extending in the axial direction and formed of a rubber material. The roller portion 42 is press-fitted on and immovably fixed to the roller shaft 41. The roller portion 42 is disposed between the support portion 33 and the support portion 37. Pivoting of the platen holder 32 about the shaft portion 31 causes the roller portion 42 to be opposed to the head 21. The roller gear 43 is disposed on the second-direction side of the cutout 39. The roller gear 43 is formed integrally with the roller shaft 41.

Figure 6:
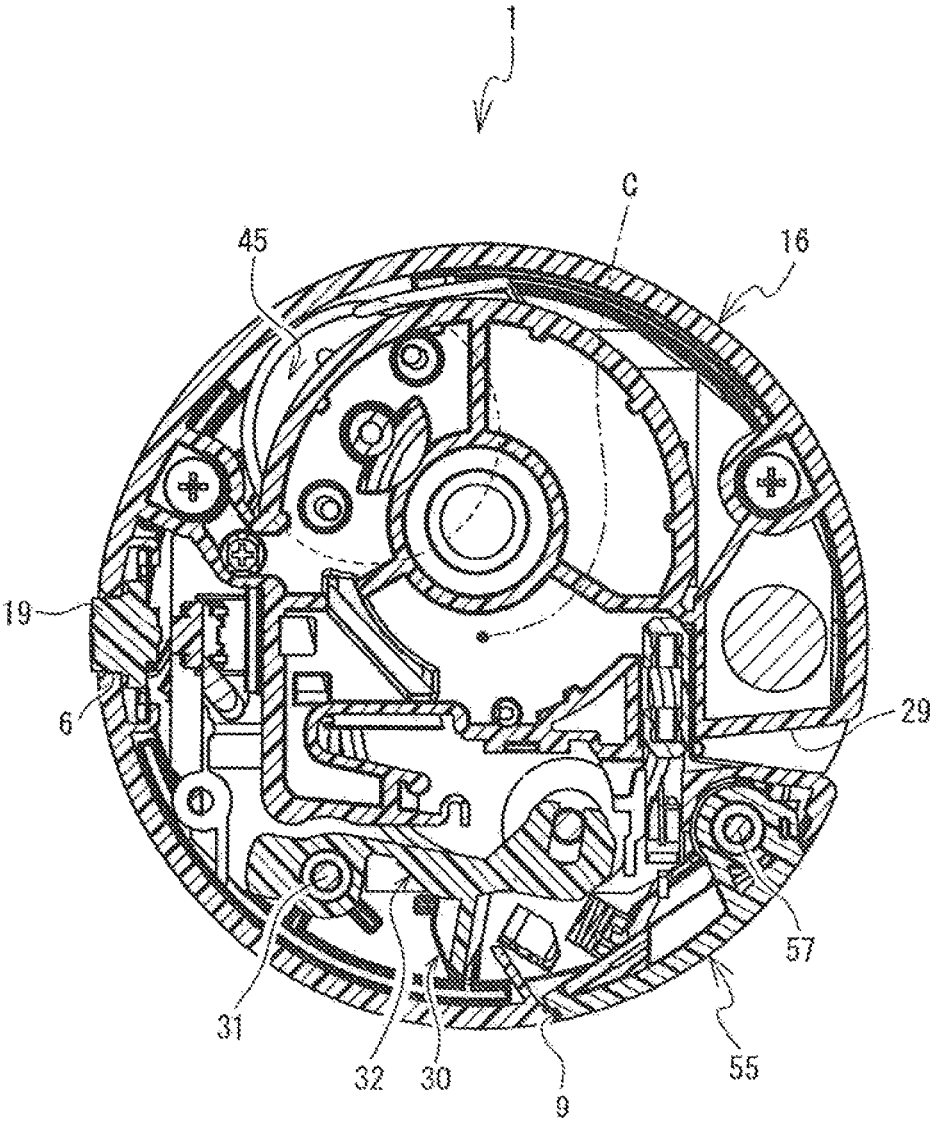
FIG. 6 is a cross-sectional view taken along line A-A in FIG. 2.

A roller spring (not shown) is a wire spring having a laterally-turned U shape. The roller spring is attached to the other end of the platen holder 32. One and the other of two distal end portions of the roller spring is disposed between the roller portion 42 and the support portion 33 and between the roller portion 42 and the support portion 37, respectively, so as to bias the roller shaft 41 toward the head 21. Thus, the roller shaft 41 is pushed to one end of the elongate hole 38. The holder spring (not shown) is a torsion spring mounted on the shaft portion 31 (FIG. 6). The holder spring biases the platen holder 32 in a direction in which the platen holder 32 pivots such that the roller portion 42 separates away from the head 21. According to this configuration, in a state in which the lid portion 15 (FIG. 1) is detached from the cylindrical portion 16, the platen holder 32 is located at its pivot position at which the roller portion 42 is away from the head 21.

As shown in FIGS. 4 and 5, a motor 45 is provided on the second-direction side of the mount portion 25 (FIG. 3). The motor 45 is a relatively heavy component among components of the printer 1. The motor 45 includes an output shaft 45A protruding toward the first-direction side and a motor gear 45B fixed to the output shaft 45A. The motor gear 45B is drivingly coupled to the gears 46, 47 so as to constitute a gear train. Each of the gears 46, 47 is a double gear constituted by a large-diameter gear and a small-diameter gear arranged in the axial direction. The large-diameter gear of the gear 46 is in mesh with the motor gear 45B, and the small-diameter gear of the gear 46 is in mesh with the large-diameter gear of the gear 47. According to this configuration, when the motor 45 is driven, the gear 47 is rotated. As later explained, the small-diameter gear of the gear 47 is meshable with the roller gear 43.

As shown in FIG. 4, a cutting mechanism 50 is provided in the housing 10. The cutting mechanism 50 is for cutting the printing medium 7 and disposed between the head 21 and the outlet 29.

Figure 7:
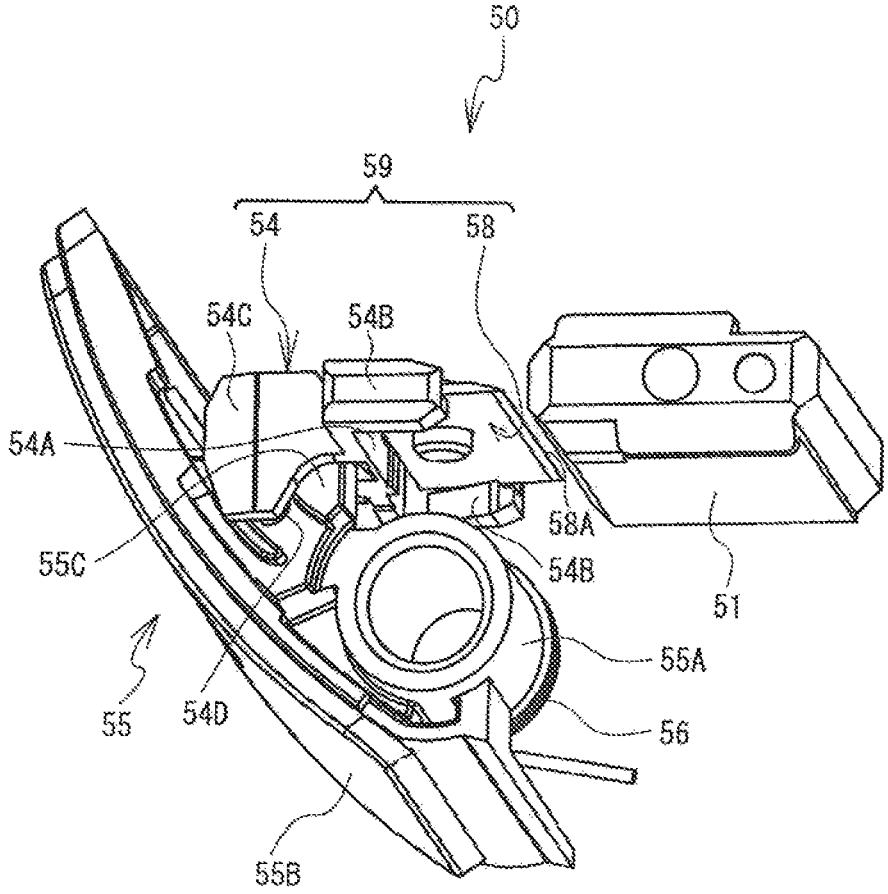
FIG. 7 is a perspective view of a cutting mechanism.

As shown in FIGS. 4 and 7, the cutting mechanism 50 includes a receiver base 51, a cutting portion 59, a lever support shaft 57 (FIG. 6), and an operation lever 55. The receiver base 51 is disposed on the same side of the medium path as the head 21. The receiver base 51 is a substantially rectangular parallelepiped extending in the axial direction.

The cutting portion 59 is opposed to the receiver base 51. The cutting portion 59 includes a holder 54 and a cutter 58. The holder 54 is movable in a direction in which the cutting portion 59 and the receiver base 51 are opposed to each other. The holder 54 includes a plate-like portion 54A, a pair of holding portions 54B, a protruding plate 54C, and a projection 54D. The plate-like portion 54A extends in the axial direction. The holding portions 54B protrude from the plate-like portion 54A toward the receiver base 51. The protruding plate 54C protrudes from the plate-like portion 54A in a direction opposite to the direction in which the holding portions 54B protrude from the plate-like portion 54A. Though not illustrated in detail, the projection 54D has a substantially D-like shape protruding from the plate-like portion 54A toward the second-direction side. The cutter 58 is a flat plate formed of metal and is held by the holding portions 54B. The cutter 58 has a blade 58A formed at one end thereof near to the receiver base 51. The blade 58A extends straight in the axial direction. The blade 58A of the cutter 58 is capable of pushing the printing medium 7 to the receiver base 51 in conjunction with the movement of the holder 54. The lever support shaft 57 (FIG. 6) extends in the axial direction at a position between the cutting portion 59 and the outlet 29 (FIG. 3).

As shown in FIG. 7, the operation lever 55 includes a bearing portion 55A, an operational portion 55B, and a contact portion 55C. The bearing portion 55A is shaped like a cylinder extending in the axial direction. The lever support shaft 57 (FIG. 6) is held in a cylindrical hole of the bearing portion 55A, and the bearing portion 55A is rotatable. The operational portion 55B is shaped like a plate extending along the circumferential direction of the cylindrical portion 16 of the housing 10 (FIG. 1). The operational portion 55B is exposed from the lever opening 9 (FIG. 1). In other words, the operational portion 55B is a plate extending so as to partly constitute the cylindrical surface 16A of the cylindrical portion 16. The operational portion 55B is connected at one of longitudinally opposite ends thereof to the bearing portion 55A. A circular recess 98 (FIG. 1) is formed on a radially outer surface of the operational portion 55B. A user can put a tip of his/her finger into the recess 98. The contact portion 55C is connected to a substantially longitudinally middle part of the operational portion 55B and located between the plate-like portion 54A and the projection 54D of the holder 54. Though not illustrated in detail, the contact portion 55C has a substantially D-like shape. A flat part of the contact portion 55C is opposed to the plate-like portion MA, and a curved part of the contact portion 55C is opposed to a curved part of the projection MD. The contact portion 55C is contactable with both the plate-like portion MA and the projection MD, whereby the operation lever 55 and the cutting portion 59 are movable in conjunction with each other. A lever spring 56, which is a torsion spring, is fitted on the bearing portion 55A. The operation lever 55 is biased by a biasing force of the lever spring 56 in a direction in which the operation lever 55 pivots such that the other of the longitudinally opposite ends of the operational portion 55B moves in a radially outward direction.

Figure 8:
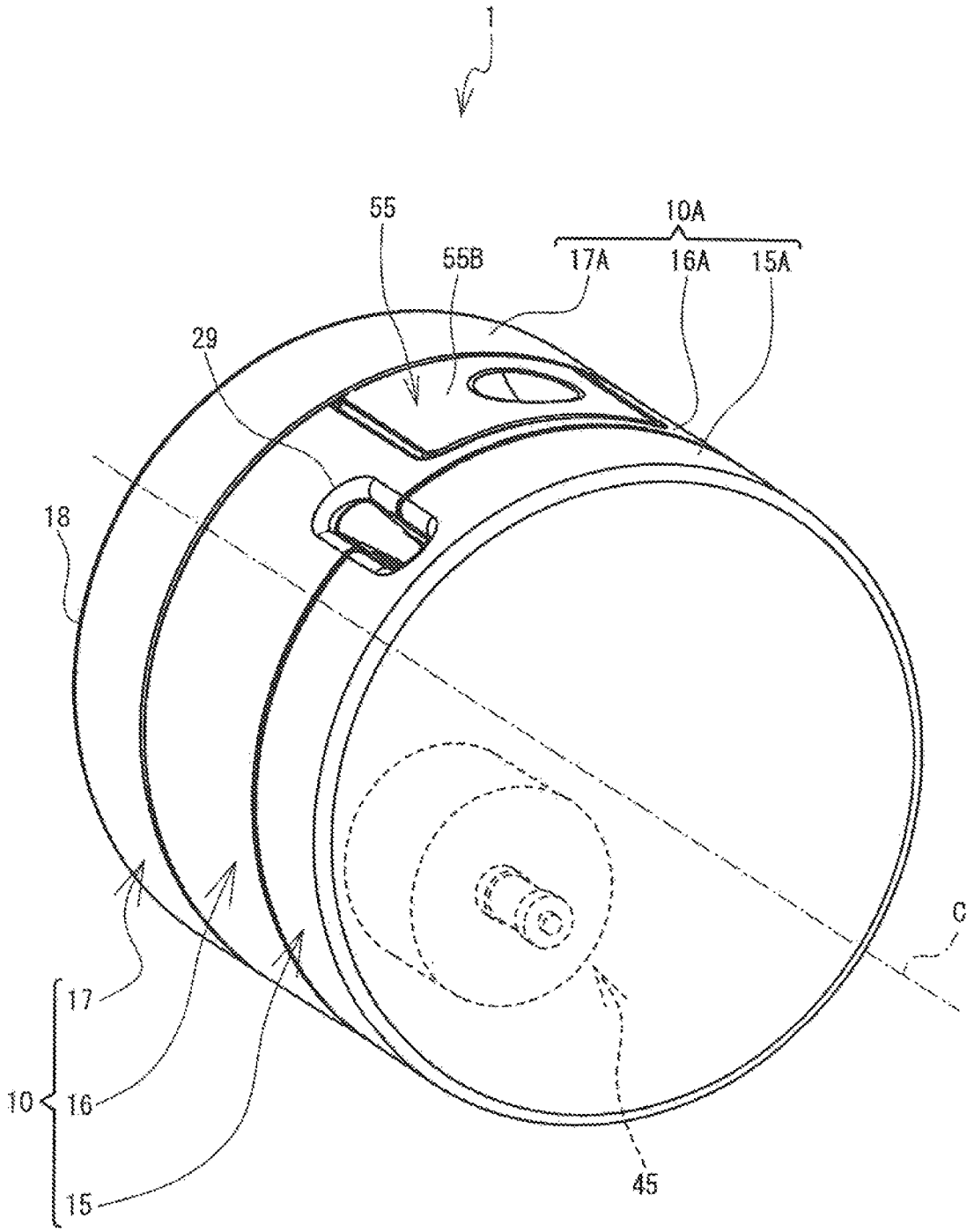
FIG. 8 is a perspective view of the printer that takes a second posture.

The housing 10 is placeable on a horizontal table 99 (FIGS. 9 and 10) in any of a first posture (FIG. 1) and a second posture (FIG. 8). (The posture taken by the housing 10 when placed on the table 99 may be referred to as a placement posture.) The first posture is a posture of the housing 10 in which the circular flat surface 18 is opposed to and in contact with the table 99. That is, the lower side of the sheet plane of FIG. 1 corresponds to the lower side in the vertical direction. In the first posture, the circular flat surface 18 is opposed to and in contact with the table 99, so that the housing 10 keeps the first posture on the table 99.

The second posture is a posture of the housing 10 in which a specific portion of the cylindrical surface 10A is opposed to the table 99. That is, the lower side of the sheet plane of FIG. 8 corresponds to the lower side in the vertical direction. When the housing 10 takes the second posture, the motor 45 is located in the housing 10 right under the axis C of the housing 10. Here, the concept that "the motor 45 is located right under the axis C of the housing 10" means that the motor 45 is located substantially right under the axis C of the housing 10, in other words, at least a part of the motor 45 is located right under the axis C. The motor 45 is located substantially right under the axis C, so that the center of gravity of the printer 1 is located at a height level lower than the axis C. Specifically, when the housing 10 takes the second posture, the center of gravity of the printer 1 is located at the lowest position in the vertical direction.

In the case where an external force that rolls the housing 10 that remains at rest in the second posture acts on the housing 10, the center of gravity of the printer 1 shifts upward. In this case, the printer 1 rolls by its own weight in a direction in which the center of gravity shifts back toward the lowest position. In other words, the printer 1 rolls by its own weight in a direction against the external force. Thus, even when the external force that causes rolling of the housing 10 acts on the housing 10, the rolling of the housing 10 is gradually suppressed and the housing 10 finally comes to rest in the second posture. Further, even in a situation in which the cylindrical surface 10A is placed on the table 99 such that the motor 45 is located at a height level higher than the axis C as shown in FIG. 6 and the center of gravity of the printer 1 is accordingly located at a height level higher than the axis C, the housing 10 rolls on the table 99 in the direction in which the center of gravity shifts toward the lowest position and finally comes to rest in the second posture. Thus, the motor 45 functions as a second-posture keeping structure to keep the housing 10 in the second posture in a state in which the cylindrical surface 10A is opposed to the table 99. Specifically, the second-posture keeping structure is realized by a structure in which the motor 45 is located in the housing 10 substantially right under the axis C of the housing 10 when the housing 10 takes the second posture.

It is noted that the power button 19 and the outlet 29 are spaced apart upward from the table 99 both when the housing 10 is in the first posture and when the housing 10 is in the second posture. Thus, the power button 19 is disposed at a position at which the power button 19 is operable by the user irrespective of whether the housing 10 takes the first posture or the second posture. Further, the outlet 29 is formed such that the printing medium 7 stored in the housing 10 is dischargeable from the outlet 29 irrespective of whether the housing 10 takes the first posture or the second posture on the table 99. Accordingly, the printer 1 can perform the printing operation on the printing medium 7 irrespective of whether the housing 10 takes the first posture or the second posture.

The operation lever 55 is spaced apart upward from the table 99 irrespective of whether the housing 10 takes the first posture or the second posture. Thus, the user can easily operate the operation lever 55 both when the housing 10 is in the first posture and when the housing 10 is in the second posture. Especially when the housing 10 takes the second posture, the operation lever 55 is located right above the axis C of the housing 10 as shown in FIG. 8. Here, the concept that "the operation lever 55 is located right above the axis C of the housing 10" means that the operation lever 55 is located substantially right above the axis C of the housing 10, in other words, at least a part of the operation lever 55 is located right above the axis C. In a state in which the housing 10 takes the second posture, the user applies a force in a substantially vertically downward direction to the operation lever 55 located substantially right above the axis C, whereby the user can operate the operation lever 55 with the housing 10 being prevented from rolling.

Referring next to FIGS. 1, 3, and 5, the printing operation of the printer 1 will be explained. The lid portion 15 is detached from the cylindrical portion 16 before starting the printing operation. The user mounts, on the mount shaft 26, the roll 8 on which the printing medium 7 is wound, so as to install the printing medium 7 on the mount portion 25. The user subsequently pulls, near to the outlet 29, the printing medium 7 drawn from the roll 8 and then attaches the lid portion 15 to the cylindrical portion 16. In the process of attaching the lid portion 15 to the cylindrical portion 16, the downward extending portion (not shown) of the lid portion 15 passes through the insertion hole 4A of the inner cover 4 and moves toward the second-direction side while sliding relative to the platen holder 32. In this instance, the downward extending portion pushes the platen holder 32 toward the head 21, so that the platen holder 32 pivots against the biasing force of the holder spring. The platen holder 32 stops at its pivot position at which the printing medium 7 is nipped by and between the platen roller 40 and the head 21. In this instance, the roller gear 43 comes into mesh with the small-diameter gear of the gear 47. In this way, the attachment of the lid portion 15 to the cylindrical portion 16 is completed. In this state, though the roller shaft 41 is away from the one end of the elongate hole 38, the platen roller 40 can push the printing medium 7 toward the head 21 by the biasing force of the roller spring.

The user places the housing 10 on the table 99 such that the housing 10 takes the first posture, for instance, and pushes the power button 19 to turn on the printer 1. The CPU drives the motor 45 when the print information received by the communication device is output to the CPU. The platen roller 40 starts to be rotated by the drive force transmitted from the motor 45, and the conveyor mechanism 30 conveys the printing medium 7 toward the outlet 29. At the same time, the heat generating elements of the head 21 are selectively heated by the CPU, so that characters indicated by the print information are printed on the printing medium 7. The printing medium 7 on which the printing operation has been performed is discharged from the outlet 29. The CPU thereafter stops driving the motor 45 and the head 21.

Referring to FIGS. 1 and 7, there will be explained a cutting operation of the printer 1. The user puts the tip of his/her forefinger into the recess 98, for instance, and pushes the operational portion 55B. The operation lever 55 pivots against the biasing force of the lever spring 56 (FIG. 7), so that the contact portion 55C pushes the plate-like portion 54A toward the receiver base 51. As a result, the holder 54 is moved toward the receiver base 51 in conjunction with the pivotal movement of the operation lever 55. The blade 58A of the cutter 58 cooperates with the receiver base 51 to sandwich the printing medium 7 therebetween. When the user further pushes the operational portion 55B, the blade 58A cuts the printing medium 7 across the axial direction. In this way, the cutting mechanism 50 cuts the printing medium 7, and the user takes out the printing medium 7 on which the characters are printed.

After the printing medium 7 has been cut, the user releases the operation lever 55. The operation lever 55 pivots back toward its original pivot position by the biasing force of the lever spring 56. The curved part of the contact portion 55C pushes the projection 54D radially outwardly while sliding relative to the curved part of the projection 54D. Thus, the operation lever 55 and the holder 54 return to the respective original states in conjunction with each other.

The housing 10 may be placed on the table 99 so as to take the second posture (FIG. 8) after the lid portion 15 has been attached to the cylindrical portion 16. Also in this case, the printer 1 can perform the printing operation and the cutting operation in order as in the case in which the housing 10 is placed on the table 99 so as to take the first posture.

As explained above, when the housing 10 takes the first posture, the circular flat surface 18 is opposed to the table 99, so that the housing 10 can be placed on the table 99 with high stability in the first posture. When the housing 10 takes the second posture, the motor 45, specifically, the second-posture keeping structure, makes it possible to keep the housing 10 in the second posture, so that the housing 10 can be placed on the table 99 with high stability in the second posture. Thus, the printer 1 can perform the printing operation irrespective of whether the housing 10 takes the first posture or the second posture on the table 99. Accordingly, the printer 1 that takes a plurality of placement postures on the table 99 in which the printing operation is performable is constructed.

The power button 19 is operable by the user irrespective of whether the housing 10 takes the first posture or the second posture, thus enabling the user to easily operate the power button 19.

The operation lever 55 is operated by the user to cause the cutting portion 59 to operate. The operation lever 55 is located substantially right above the axis C when the housing 10 takes the second posture. Accordingly, by pushing the operation lever 55 in the substantially vertically downward direction, the user can operate the operation lever 55 with the housing 10 being prevented from rolling.

The motor 45 is relatively heavy among components of the printer 1. Accordingly, the center of gravity of the printer 1 is located near the motor 45. When the housing 10 takes the second posture, the motor 45 is located substantially right under the axis C, and the center of gravity of the printer 1 is accordingly located at a height level lower than the axis C of the housing 10. Thus, even when the external force is applied to the housing 10 that is in the second posture and the housing 10 rolls on the table 99, the rolling of the housing 10 is gradually suppressed and the printer 1 returns back to the second posture. Accordingly, the housing 10 comes to rest in the second posture with high stability.

In the illustrated embodiment, the motor 45 is one example of the second-posture keeping structure of the present disclosure.

The present disclosure is not limited to the details of the illustrated embodiment. The lid portion 17 may include three protrusions that protrude from the circular flat surface 18 toward the second-direction side. In this case, it is preferable that the three protrusions be disposed at an equiangular pitch in the circumferential direction near the periphery of the circular flat surface 18. When the housing 10 takes the first posture on the table 99, the three protrusions may be in contact with the table 99. In this case, the circular flat surface 18 is opposed to and spaced apart from the table 99, unlike the circular flat surface 18 in the illustrated embodiment that is opposed to and in contact with the table 99. The number of the protrusions is not limited to three.

The power button 19 may be a touch panel provided on the cylindrical surface 10A, instead of the cylindrical columnar member describe above. Also in this case, the power button 19 is provided so as to partly constitute the cylindrical surface 10A.

Figure 9:
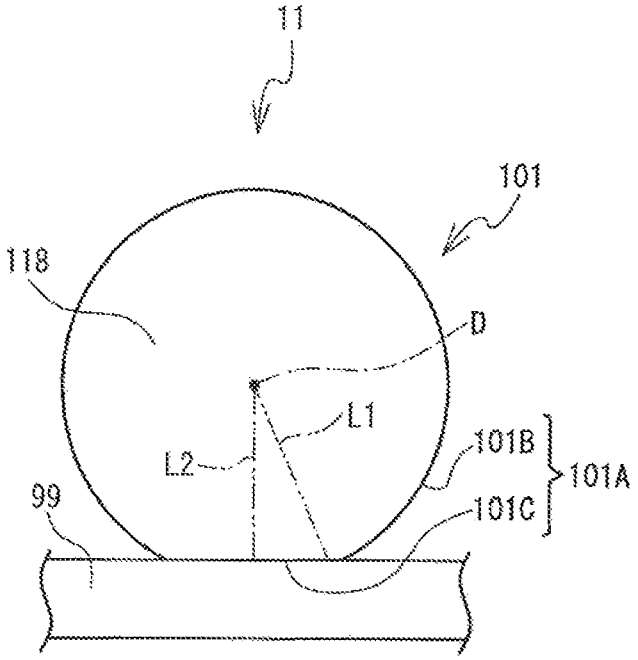
FIG. 9 is a view of a printer according to a first modification that takes a second posture.

Referring to FIG. 9, there will be explained a printer 11 according to a first modification. The printer 11 includes a housing 101 in place of the housing 10 of the printer 1 of the illustrated embodiment. The housing 101 has a cylindrical shape and includes a circular flat surface 118 and a cylindrical surface 101A. The circular flat surface 118 is a flat surface having a substantially circular shape. The cylindrical surface 101A extends along the periphery of the circular flat surface 118. The cylindrical surface 101A of the housing 101 includes a curved portion 101B and a flat portion 101C. The curved portion 101B extends in the circumferential direction of the housing 101 so as to have an arcuate shape. The flat portion 101C includes a flat surface connected to circumferentially opposite ends of the curved portion 101B. In the flat portion 101C, a distance from an axis D of the housing 101, e.g., a length of line segments L1, L2, changes along the circumferential direction of the housing 101. It is noted that the length of the flat portion 101C in the circumferential direction may be longer than or shorter than that shown in FIG. 9.

Though not shown, the circular flat surface 118 is opposed to and in contact with the table 99 when the housing 101 takes the first posture. When the housing 101 takes the second posture, the flat portion 101C is opposed to and in contact with the table 99 as shown in FIG. 9. In the flat portion 101C, the distance from the axis D changes along the circumferential direction. In this configuration, if the housing 101 that is at rest in the second posture rolls, the center of gravity of the housing 101 needs to shift upward. Thus, even when the external force that causes rolling of the housing 101 placed on the table 99 in the second posture is applied to the housing 101, the housing 101 does not easily roll. That is, the flat portion 101C functions as the second-posture keeping structure to keep the housing 101 in the second posture. It is thus possible, in the printer 11, to prevent the housing 101 in the second posture from rolling on the table 99. Accordingly, the housing 101 keeps the second posture with high stability. In this first modification, the flat portion 101C is one example of the second-posture keeping structure and one example of the specific portion of the cylindrical surface. In other words, the second-posture keeping structure is realized by a structure in which the cylindrical surface 101A of the housing 101 includes the flat portion 101C as the specific portion.

In the printer 11, the motor 45 (FIG. 6) may be located above or under the axis D when the housing 101 takes the second posture. The housing 101 of the printer 11 has a substantially D-like shape when viewed in a direction of extension of the axis D. Instead, the housing 101 may have a substantially oblong shape. In this case, the cylindrical surface 101A includes two flat portions 101C which face in mutually opposite directions and one circumferential end of each of which is connected to one of two curved portions 101B that face in mutually opposite directions.

Figure 10:
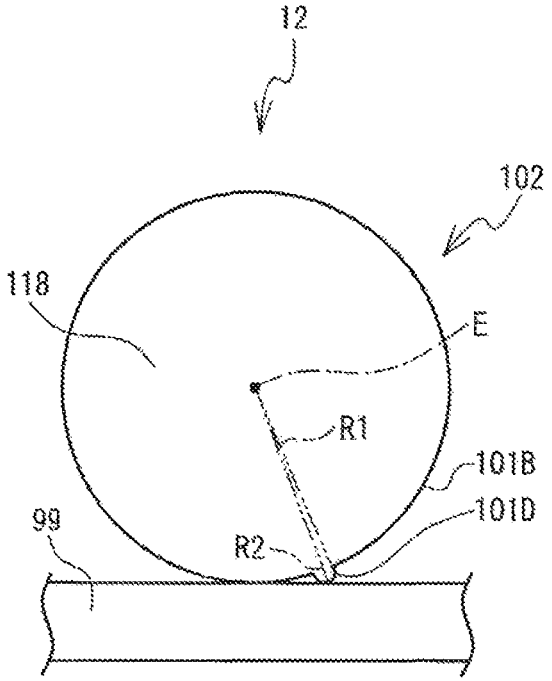
FIG. 10 is a view of a printer according to a second modification that takes a second posture.

Referring to FIG. 10, there will be explained a printer 12 according to a second modification. The printer 12 includes a housing 102 in place of the housing 101 (FIG. 9) of the printer 11. The housing 102 differs from the housing 101 in that the housing 102 includes a protruding portion 101D in place of the flat portion 101C. The protruding portion 101D protrudes from the curved portion 101B in a direction away from an axis E of the housing 102. In the protruding portion 101D, a distance from the axis E, e.g., a length of line segments R1, R2, changes along the circumferential direction of the housing 102.

When the housing 102 takes the second posture, the protruding portion 101D and a part of the curved portion 101B are in contact with the table 99. Accordingly, even when the external force that causes rolling of the housing 102 is applied to the housing 102, the housing 102 placed on the table 99 in the second posture is prevented from rolling on the table 99 because the protruding portion 101D is in contact with the table 99. Thus, the housing 102 keeps the second posture with higher reliability. In this second modification, the protruding portion 101D is one example of the second-posture keeping structure and one example of a part of the specific portion of the cylindrical surface. In other words, the second-posture keeping structure is realized by a structure in which the cylindrical surface 101A of the housing 102 includes the protruding portion 101D as the specific portion.

The housing 102 may include a pair of protruding portions 101D. In this case, when the housing 102 takes the second posture, the protruding portions 101D may be in contact with the table 99 while the curved portion 101B may be spaced apart from the table 99 without contacting the table 99.

What is claimed is:

1. A printer configured to perform a printing operation on a printing medium, comprising:

a housing having a cylindrical shape and including a bottom surface and a cylindrical surface on which an outlet is formed, the housing being configured to be placed on a horizontal table in any of a first posture in which the bottom surface is opposed to the table and a second posture in which a specific portion of the cylindrical surface is opposed to the table, the outlet being formed at a position of the cylindrical surface at which the printing medium stored in the housing is dischargeable from the outlet irrespective of whether the housing takes the first posture or the second posture on the table;

a single motor;

a conveyor mechanism driven by the single motor to convey the printing medium; and a second-posture keeping structure to keep the housing in the second posture in a state in which the cylindrical surface is opposed to the table, wherein the second-posture keeping structure is realized by a structure in which the single motor is located in the housing right under an axis of the housing when the housing takes the second posture.

2. The printer according to claim 1, further comprising a power button provided so as to partly constitute the cylindrical surface, wherein the power button is disposed at a position at which the power button is operable by a user irrespective of whether the housing takes the first posture or the second posture.

3. The printer according to claim 1, further comprising: a cutting mechanism disposed in the housing for cutting the printing medium discharged from the outlet; and an operation lever which is provided so as to partly constitute the cylindrical surface and which is operated by a user to cause the cutting mechanism to operate, wherein the operation lever is located right above an axis of the housing when the housing takes the second posture.

4. The printer according to claim 1, wherein the second-posture keeping structure is realized by a structure in which the specific portion includes a part of the cylindrical surface in which a distance from an axis of the housing changes along a circumferential direction of the housing, and wherein the part of the cylindrical surface is in contact with the table when the housing takes the second posture.

5. The printer according to claim 4, wherein the cylindrical surface of the housing includes a curved portion that extends in the circumferential direction of the housing so as to have an arcuate shape, wherein the specific portion includes a flat portion that is a flat surface connected to one end of the curved portion in the circumferential direction, and wherein the flat portion is opposed to and in contact with the table when the housing takes the second posture.

6. The printer according to claim 4, wherein the cylindrical surface of the housing includes a curved portion that extends in the circumferential direction of the housing so as to have an arcuate shape, wherein the specific portion includes a protruding portion that protrudes from the curved portion in a direction away from the axis of the housing, and wherein the protruding portion is in contact with the table when the housing takes the second posture.

7. The printer according to claim 1, wherein the specific portion is a portion of the cylindrical surface that is to be in contact with the table, and wherein the outlet is formed at a portion of the cylindrical surface other than the specific portion.

8. The printer according to claim 1, wherein the outlet is formed on the cylindrical surface of the housing so as to extend in an axial direction of the housing.

9. The printer according to claim 1, wherein the outlet is formed on the cylindrical surface of the housing so as to extend in a circumferential direction of the bottom surface.

10. A printer configured to perform a printing operation on a printing medium, comprising:

a housing having a cylindrical shape and including a bottom surface and a cylindrical surface on which an outlet is defined, the housing being configured to be placed on a horizontal table in any of a first posture in which the bottom surface is opposed to the table and a second posture in which a specific portion of the cylindrical surface is opposed to the table, the specific portion being a part of the cylindrical surface, the outlet being defined at a position of the cylindrical surface at which the printing medium stored in the housing is dischargeable from the outlet irrespective of whether the housing takes the first posture or the second posture on the table; and a second-posture keeping structure to keep the housing in the second posture in a state in which the specific portion of the cylindrical surface is opposed to the table, wherein the printer further comprises a recess provided in the housing, the printing medium being mounted in the recess.

11. The printer according to claim 10, wherein a mount shaft is disposed in the recess, wherein the mount shaft is configured such that a roll of the printing medium is mounted on the mount shaft, and wherein an axis of the mount shaft is parallel with an axis of the housing.

12. The printer according to claim 10, wherein, in a state in which the printing medium is mounted in the recess, an entirety of the printing medium in an unprinted state is disposed within the housing.

13. The printer according to claim 10, wherein the axis of the housing passes through the recess.

14. A printer configured to perform a printing operation on a printing medium, comprising:

a housing having a cylindrical shape with an axis and including a bottom surface and a cylindrical surface on which is defined an outlet through which the printing medium is dischargeable;

a cutting mechanism provided in the housing and configured to cut the printing medium discharged through the outlet; and an operational portion defined on the cylindrical surface and configured to cause the cutting mechanism to operate, wherein, when the printer is placed on a horizontal table such that the cylindrical surface is opposed to the table, the outlet is not located on the table and the operational portion is not located on the table.

15. The printer according to claim 14, further comprising a power button by which the printer is turned on and off, wherein, when the printer is placed on the table such that the cylindrical surface is opposed to the table, the power button is not located on the table.

16. The printer according to claim 15, further comprising a motor and a conveyor driven by the motor to convey the printing medium, wherein, when the printer is placed on the table such that the cylindrical surface is opposed to the table, the motor is located opposite to the power button with respect to the axis of the housing.

17. The printer according to claim 14, further comprising a recess provided in the housing, the printing medium being mounted in the housing.

18. The printer according to claim 17, wherein a mount shaft is disposed in the housing, wherein the mount shaft is configured such that a roll of the printing medium is mounted on the mount shaft, and wherein an axis of the mount shaft is parallel with the axis of the housing.

19. The printer according to claim 17, wherein the axis of the housing passes through the recess.

20. The printer according to claim 17, wherein, in a state in which the printing medium is mounted in the recess, an entirety of the printing medium in an unprinted state is disposed within the housing.

21. The printer according to claim 14, further comprising a motor and a conveyor driven by the motor to convey the printing medium, wherein, when the printer is placed on the table such that the cylindrical surface is opposed to the table, the motor is located below the axis of the housing.

* * * * *